United States Patent [19]

Larson

[11] Patent Number: 4,542,863

[45] Date of Patent: Sep. 24, 1985

[54] PIPE-THREAD SEALING TAPE REEL WITH TAPE RETARDING ELEMENT

[76] Inventor: Edwin L. Larson, 2501 Wellesley Ave., Los Angeles, Calif. 90064

[21] Appl. No.: 633,611

[22] Filed: Jul. 23, 1984

[51] Int. Cl.[4] ..... B65H 75/16; E21B 31/00

[52] U.S. Cl. ..... 242/96; 206/398; 206/53; 242/99

[58] Field of Search ..... 242/75.2, 76, 96, 99, 242/84.8, 147, 156; 206/53, 55, 398, 400

[56] References Cited

U.S. PATENT DOCUMENTS

| | | | |
|---|---|---|---|
| 1,468,636 | 9/1923 | Hoeft | 206/53 |
| 1,493,381 | 5/1924 | Phelps | 206/400 |
| 2,044,791 | 6/1936 | Hoffman | 206/398 |
| 2,229,961 | 1/1941 | Deane | 206/53 |
| 2,444,117 | 6/1948 | Sloane et al. | 206/398 |
| 3,019,893 | 2/1962 | Jacobs et al. | 206/53 |
| 3,355,123 | 11/1967 | Schinske | 242/84.8 |
| 3,424,435 | 1/1969 | Niemann | 242/84.8 |
| 3,765,618 | 10/1973 | Johnson et al. | 242/99 X |

FOREIGN PATENT DOCUMENTS

| | | | |
|---|---|---|---|
| 1123615 | 11/1956 | France | 206/53 |
| 1341996 | 12/1962 | France | 242/99 |

*Primary Examiner*—Stuart S. Levy
*Assistant Examiner*—Lloyd D. Doigan
*Attorney, Agent, or Firm*—Milton S. Gerstein

[57] ABSTRACT

An improved reel for dispensing threaded-pipe sealing tape is disclosed, wherein a tape retarding element is provided and mounted for circular movement about the periphery of the reel. The tape retarding element is mounted between the side flanges of the reel so that an applied force must be tangentially directed thereto to overcome the friction between the tape retarding element and the side flange portions between which the tape retarding element is mounted. The tape retarding element allows for the paying out of the tape for its wrapping about the threaded end of a pipe, but prevents the accidental unwinding of the tape upon the dropping of the reel from a user's hand.

3 Claims, 7 Drawing Figures

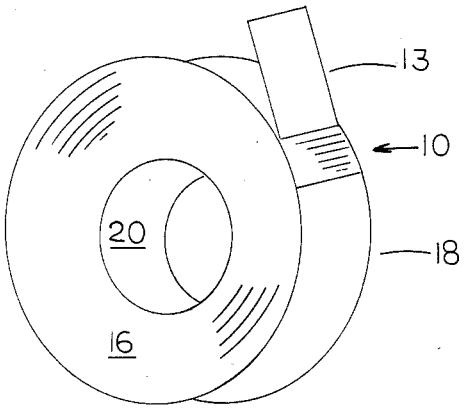
FIG 1
FIG 3
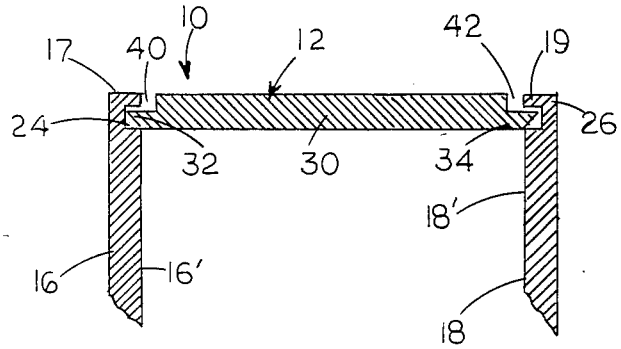
FIG 2
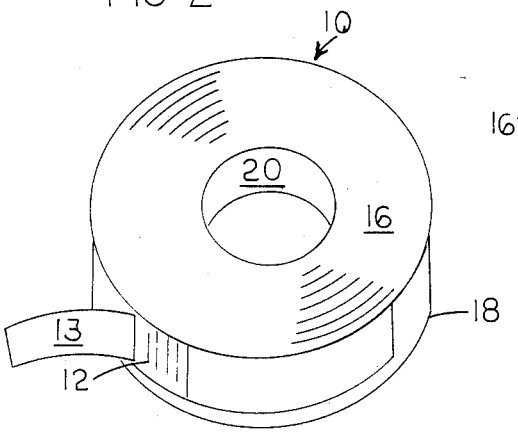
FIG 4
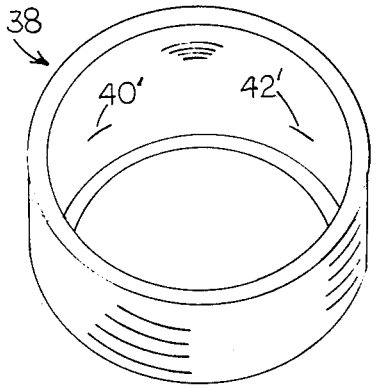
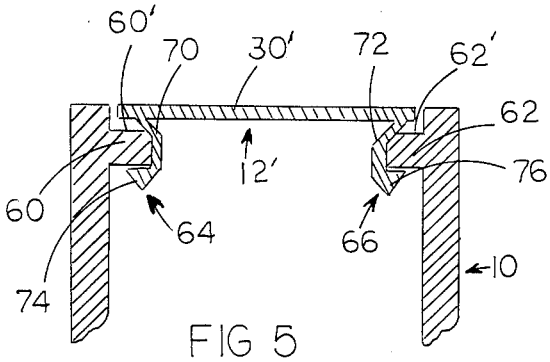
FIG 5
FIG 6
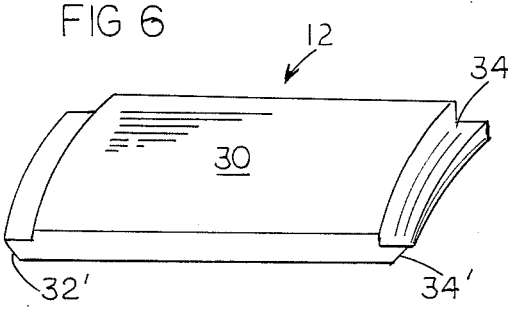
FIG 7
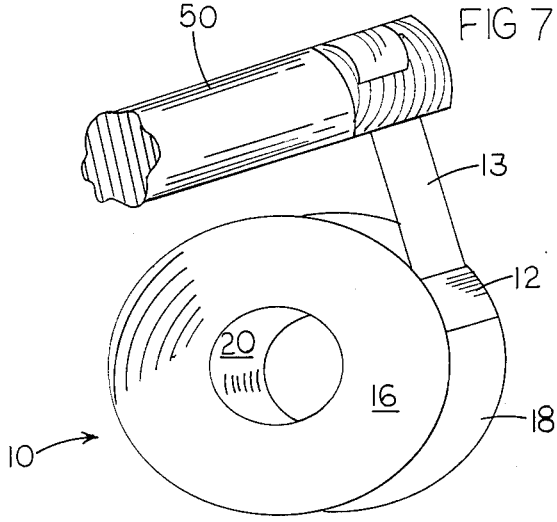

PIPE-THREAD SEALING TAPE REEL WITH TAPE RETARDING ELEMENT

BACKGROUND OF THE INVENTION

The present invention is directed to a reel for dispensing pipe-thread tape, which tape is used to seal the threaded ends of pipes, and the like.

Reels for paying out pipe-thread sealing tape are usually hand-held and rotated by inserting a finger or fingers into the hollow hub of the reel and rotating the reel about the finger or fingers. The tape paid out is then wrapped around the threaded end of the pipe, or the like. However, it often occurs, due to the tediousness of the task, and margin for error, that the hand-held reel drops off from the finger which is used for the rotational axis of the hub of the reel. When such an accident occurs, long lengths of tape tend to become unrolled from the reel. often become twisted, and thus making it very difficult to wind the tape back on to the reel for subsequent dispensing therefrom. Further, much time is lost in trying to unravel the free tape, or winding it back on to the reel. The fact that the lead end of the tape, which has been already wrapped about the threaded end of the pipe to begin the sealing procedure, is firmly anchored to the threaded end of the pipe only after a couple of turns means that, when the reel does become loose and falls free, the anchored free end provides a reaction force to the reel that causes it to roll and unwind even more than if the lead end were not anchored. Further, it is also the case that the reel itself is used in close proximity to the pipe being sealed, which pipe typically is a considerable distance from the floor or ground, so that even more tape tends to become loose and unwound from the reel upon accidental dropping of the reel from the hand.

SUMMARY OF THE INVENTION

It is, therefore, the primary object of the present invention to provide an improved tape reel in which any accidental dropping of the reel during paying out of the tape for sealing a threaded end of a pipe will not result in the reel's falling to the floor with the concomitant unravelling of the tape therefrom.

It is still another object of the present invention to provide an improved reel for dispensing tape, such that if the reel does become accidentally free of the user's hand, which hand provides a finger or fingers for the rotational axis of the hub of the reel, the reel will not descend or otherwise be removed from the area of the location at which the threaded pipe is situated.

It is still another object of the present invention to provide an improved threaded-pipe sealing tape reel that will allow for easy dispensation of the sealing tape therefrom upon normal, hand-held use of the reel, for winding the tape to the end of the pipe, or the like.

It is still another object of the present invention to provide an improved tape reel which will still readily accept a conventional closure element for storing the reel during non-use.

Toward these above ends, the present invention provides a tape reel for pipe-thread sealing tape in which there is mounted between the outer portions of the side flanges of the reel, for circular movement therearound, a tape retarding element. Each inner face of the side flanges has a circular groove, in the first embodiment of the invention, in which are received tongue members of the tape retarding element, which tongue members project laterally from the main body portion of the tape retarding element, whereby the tongue members ride in the circular grooves of the inner faces of the side flanges, for rotational movement about the reel, adjacent the outer circumferential edge surfaces of the flanges. The tongue members of the tape retarding element are received, by a snug fit, in the circular grooves, so that enough frictional force is generated which must be overcome in order to move the retarding element, and, therefore, pay out tape from the reel. Thus, upon accidental dropping of the reel, the force created by gravity upon the free-falling tape reel will not be great enough to overcome the frictional forces between the tongue members and the surface walls of the circular grooves. To aid in the mounting of the tape retarding element to the reel between outer portions of the side flanges, each tongue member is provided with an inwardly facing canted surface, so that when the retarding element is mounted the canted surfaces force apart the two side flanges to allow entry of the tape retarding element with the tongue members snapping into the circular grooves upon sufficient force applied to the retarding element in a direction toward the center of the hub of the reel. Also, each tongue member of the retarding element spaces an end of the main body portion of the retarding element from the inner face of a side flange, so as to constitute a gap on either end of the retarding element, in which is received locking projections of a conventional closure cylinder, only one of the gaps at any one storage receiving therein the projections of the closure cylinder. Further, the outer surface of the main body portion is curved and lies in the same plane as the outer edge surfaces of the flanges, so that the closure element may be mounted over the side flanges for storage.

In the second embodiment of the tape retarding element, the grooves of the side flanges are replaced by circular ribs or beads, while the tongue members of the retarding element are replaced by prong members which hug the circular beads at portions thereof and snap into place by utilizing a prong that nestles under the inner surface of the rib.

BRIEF DESCRIPTION OF THE DRAWING

The invention will be more readily understood with reference to the accompanying drawing, wherein FIG. 1 is a perspective view showing the improved reel for paying out tape of the present invention in which the tape retarding element is shown mounted for circular movement adjacent the outer periphery of the reel;

FIG. 2 is a perspective view showing the improved tape reel of the present invention at a different angle from that of FIG. 1;

FIG. 3 is a cross-sectional view showing the tape retarding element mounted for sliding engagement in circular grooves of the inner faces of the flanges of the improved reel of the present invention;

FIG. 4 is a perspective view showing a storage cover for closing off the improved reel of the present invention when not in use;

FIG. 5 is a cross-sectional view showing another embodiment of the tape retarding element of the present invention;

FIG. 6 is a perspective view showing the tape retarding element of the first embodiment of the present invention; and FIG. 7 is a perspective view showing the improved tape reel of the present invention in use, with the tape retarding element being used to wrap sealing tape about the threaded end of a pipe.

DETAILED DESCRIPTION OF THE INVENTION

FIGS. 1, 2, 3, and 6 show the improved tape reel 10 of the present invention in which a tape retarding or tape-hold-back element 12 is provided for movement about the reel adjacent the outer periphery thereof. The reel 10 has a pair of side flanges 16 and 18 supported centrally by a hollow hub 20. The hollow hub 20 allows for a finger, or fingers, or other means, to be inserted therein and about which the reel 10 may be rotated for paying out tape 13. The tape 13 may be any tape at all, though for purposes of disclosure, the tape 13 is pipe-thread sealing tape that is wrapped around the threaded ends of pipes for sealing them tight. Such tape is typically made of Teflon and is non-adhesive. The tape 13 is usually applied to the ends of the pipe by rotating the reel 10 about a finger or other element, in the hollow hub, thereby paying out tape, and simultaneously revolving the tape about the pipe's threaded end to wrap the tape around the pipe as many times as necessary to achieve proper sealing. Since it often occurs that the reel falls from the hand of the user applying the tape to the pipe, the tape may unwind freely, thus causing long lengths of tape 14 to be unwound from the reel in a haphazard and confusing fashion necessitating the rewinding of the tape on to the reel before re-commencing the sealing procedure. In order to prevent the unwanted and undesirable accidental unwinding of the tape from the reel upon the dropping thereof, the present invention provides the tape retarding element 12. The tape retarding element 12 is best seen in FIGS. 3 and 6. The tape retarding element 12 is basically of arcuate shape to conform to the curvature of the outer portion of the side flanges 16 and 18, to which and between which the tape retarding element is mounted for sliding movement adjacent the circumference of the flanges in grooves 24 and 26 provided in the inner faces 16′ and 18′ of the flanges. The grooves 24 and 26 extend about inner faces 16′ and 18′, respectively, in a complete circle, with the center of radius of each circle lying at the center of a respective side flange, so that the tape retarding element may be rotated about the reel through 360 degrees. The tape retarding element 12 has a main body portion 30 of arcuate configuration to conform to the curve of the outer portion of the side flanges, and a pair of laterally projecting tongue members 32 and 34 extending from either end of the main body portion 30. Each tongue member 32,34 has a thickness less than that of the main body portion, which thickness is taken in a direction parallel to the radius of the respective side flange in which the tongue member is mounted for sliding movement. The distance between the outer surface portion of each tongue member to the outer surface of the main body portion 30 is approximately equal to the distance from the peripheral edge surface of each side flange to the outermost part of its respective groove, so that the outer surface of the main body portion lies flush and in the same arcuate plane as the outer peripheral edge surface of each flange, so that no portion of the tape retarding element projects beyond the peripheral edge surfaces of the side flanges, whereby a covering cylindrical element 38 shown in FIG. 4 may be slid over one of the side flanges and toward the other side flange, to cover and store the reel during non-use. Each tongue member 32 and 34 is also provided with an inner canted surface 32′ and 34′ which, as shown in FIG. 3, allows for the mounting of the tape retarding element to the reel. The canted surfaces 32′ and 34′ force apart the flanges 16 and 18 at the outer portions thereof where the tape retarding element is initially mounted. By applying a force on the tape retarding element in a radial direction toward the center of the hollow hub 20, the canted surfaces force apart the outer peripheral edge surfaces 17 and 19, whereby the tongue members 32 and 34 may be snapped into respective grooves 24 and 26.

Each tongue member is also of arcuate configuration along its width to conform to the curvature of its respective groove. Further, the length of each tongue member, taken in a direction parallel to the longitudinal axis of the hub 20, is such that the edge end faces of the main body portion 30 are spaced from the inner faces 16′ and 18′, in order to define gaps 40 and 42, as shown in FIG. 3. These gaps 40 and 42 allow for the locking projections 40′ and 42′ to enter therein, though when mounting the cover 38 to the reel 10, only one gap is used for the two projections. The two gaps 40 and 42 allow for the mounting of the cover element 38 to the reel starting at either the side flange 16 or side flange 18. The cover element 38 and its projections are well-known in the art.

The tape retarding element 12 is so dimensioned as to provide a very snug fit within the grooves 24 and 26, and between the side flanges, so that applied force must be used to move the tape retarding element along the circular grooves and around the reel. This snug fit may be achieved in different ways, such as making the length of the tape retarding element from the outer edge surface of one tongue member to the outer edge surface of the other tongue member, along a line parallel to the longitudinal axis of the hollow hub 20, very slightly longer than the distance between the side walls of the grooves along the same line parallel to the longitudinal axis of the hub. This will produce frictional forces between the outer edge surface of each tongue member and the side wall of its respective groove, which side wall is parallel to the inner faces 16′ and 18′.

Alternatively, or in conjunction with the above, the thickness of each tongue member may be made approximately equal to the width of its respective groove, the thickness being taken in a direction along the radius of its respective side flange. Since each tongue member has an inner canted surface, the tongue member will be received in its respective groove at the portion thereof approximately equal to the width of the groove. Thus, the canted inner surface of each tongue member provides a dual function, where each is used for insertion of the tape retarding element between the grooves, and for allowing for frictional engagement therewith to provide frictionalforces resisting movement of the tongue members.

In use, when applying sealing tape to the threaded ends of a pipe 50, as shown in FIG. 7, the tape 13 is paid out from the reel 10 by rotating the reel about a finger of the first hand, or other element, inserted in the hollow hub 20. As the reel 10 rotates about the element in the hub, and with the free end of the tape 13 held fast to the threaded end of the pipe 50 with the other hand, a force is applied to the tape portion directly in contact with the tape retarding element 12. If enough force is applied to the reel in the direction away from the pipe, the frictional forces holding the tape retarding element may be overcome, thereby causing the movement of the tape retarding element in the circular grooves 24 and 26, allowing thepaying out of more tape. If the reel 10 is accidentally dropped from the first hand, the tape retarding element is held fast by the frictional forces holding it to the side flanges, since the weight of the fully-wound reel is not enough to provide enough force to overcome the frictional forces holding the tape retarding element in place. When the reel is forced in a direction away from the pipe 50, it is also revolved simultaneously about the threaded end of the pipe to cause the paid out tape to wrap around the threads thereof.

It is also, of course, possible to manually slide the tape retarding element along the grooves 24 and 26, thus paying out tape in a slow manner. This method may be used if it is desirable to apply only very small tensile forces to the tape, which would not be great enough to move the tape retarding element in the grooves 24 and 26. This also may be used at the very beginning of the procedure of applying tape to the threaded end of the pipe, so as to allow enough free tape to start the procedure. Either may also be adaptable to adhesive-type tapes.

In FIG. 5, there is shown an alternative embodiment for the tape retarding element. In this embodiment, the reel 10' is provided with circularly extending and laterally projecting ribs or beads 60 and 62, each of which has a canted surface portion 60' and 62', respectively. The ribs 60 and 62 provide the attaching portions for the inwardly extending flexible prong members 64 and 66 projecting from the inner surface of the main body portion 30' of the tape retarding element 12'. Each prong member projects inwardly toward the center of the hub of the reel, and also has a leg extension 70 and 72, respectively, that projects laterally toward the opposite side flange. Each leg extension 70 and 72 is connected to a prong 74 and 76 via another straight leg extension, whereby the leg extensions 70 and 72 provide portions about which the prongs 64 and 66 pivot, respectively, so that when mounting the tape retarding element 12' to the reel 10', the canted surfaces of the prongs force the prongs to pivot toward the opposite flange, to thereby snugly mount the prong members to the reel. The canted surfaces of the prongs 74 and 76 cooperate with the canted surfaces 60' and 62' of the beads 60 and 62, respectively, when mounting the tape retarding element. Enough friction is provided between the prong members 64 and 66 and the respective beads 60 and 62 so as to allow movement of the tape retarding element 12' only upon sufficient force application to the tape retarding element, as in the case of the first embodiment.

In both embodiments of the tape retarding element, all of the parts thereof are preferably formed integrally, as by injection molding, or the like, and are made preferably of flexible plastic and typically of the same material as that of the reel itself, though clearly other materials may be used. Also, in the case of the second embodiment for the tape retarding element, as in the first embodiment, the main body portion 30' is curved to conform to the curvature of the peripheral edge of the side flanges of the reel 10'. Further, each prong member 64 and 66 is similarly curved to conform to the curvature of the beads 60 and 62. Though not shown in FIG. 5, each prong member 64,66 has a substantial width taken in a direction along the circumferential length of the respective bead 60,62, thus requiring each prong member to have arcuate configuration in order to slide in its respective groove, and also to add stability and rigidity to the element. The prong members extend in width the same amount as does the main body portion 30'. Also, as in the first embodiment, gaps are provided between the inner faces of the side flanges of the reel and the ends of the main body portion of the tape retarding element, to allow for insertion into the gaps of the projecting locking elements of the conventional closure element 38 shown in FIG. 4.

While specific embodiments of the invention have been shown and described, it is to be understood that numerous changes and modifications may be made without departing from the scope, spirit, and intent of the invention, as set out in the appended claims. For example, it is within the scope and spirit of the present invention to provide a separate retarding means that may readily and easily snapped on to an existing and conventional tape reel, where the retarding means is provided with an arcuate slot or groove at each end to receive therein a peripheral edge surface of a side flange, whereby the retarding element is readily mountable between the side flanges, but project outside of the plane containing therein the arcuate edge surfaces of the flanges. In this case, though the closure element may not be used while the retarding element is still mounted, it is only necessary to remove the retarding element and then slide the closure cylinder over one of the flanges, as in the conventional manner. Further, in this case, it is possible to provide in the closure cylinder a groove or slot in which may be received a projection from the retarding element for storing it and attaching it to the closure cylinder during non-use. This allows for the tape retarding element to be readily attachable to the reel for use in paying out tape and in preventing accidental paying out of the tape.

What is claimed is:

1. An improvement in a pipe-thread sealing tape reel, in which the reel comprises a first side flange and a second side flange, and a hollow hub mounting said first side flange and said second side flange at opposite ends thereof, whereby the hollow interior of said hub allows for the grasping thereof by fingers, or the like, each of said first side flange and said second side flange projecting from the outer circumferential surface of said hub about the entire circumference thereof so as to define a retaining volume in which tape is wound for storage and dispensing therefrom, said improvement comprising:

a tape retarding means mounted between and to said first side flange and said second side flange at a portion of each near the outer peripheral surface thereof, said tape retarding means spanning the space between said side flanges, whereby tape unwound from said reel may be prevented from further dispensing upon the accidental dropping of the reel from a user's hand, whereby said tape retarding means prevents unwinding of the tape by the fact that the end of the tape wound to the thread-end of a pipe provides an anchored end, and said tape retarding means provides an anchor point for the tape to the reel itself;

each of said flanges comprising a circular groove extending around the inner surface of each said side flange, said inner surface facing in a direction toward the other of said first and second side flanges; said circular groove having a radius of curvature centered at the central longitudinal axis of said hub greater than the radius of said hub; said tape retarding means comprising means for riding in each said groove of each said side flange;

said means for riding comprising a first tongue extension for insertion into one of said grooves and a second extension for insertion into the other of said grooves, each of said tongue extensions having a thickness at at least one portion thereof slightly less than the width of the groove in which it rides, said thickness of each said tongue extension being taken in a first direction from the outer periphery of its respective side flange toward the center of the hub, and said width of said groove being taken in said first direction, also, whereby said tongue extensions provide frictional engagement with the interior of said grooves to allow positioning of said tongue extensions, and, therefore, said retarding means, at a desired location about said reel, so that said retarding means provides sufficient frictional engagement with said side flanges to keep said retarding means at its angular location during accidental dropping of said reel to prevent unwinding of the tape;

said tape retarding means further comprising a main body portion having an arcuate shape, and having a first end and a second end adjacent said first and second side flanges, respectively; said first tongue extension projecting from said first end of said main body portion, and said second tongue extension projecting from said second end of said main body portion in a second direction parallel to the longitudinal axis of said hub; the length of said retarding means being measured from the end of said first tongue extension to the end of said second tongue extension, said ends of said tongue extensions being mounted in said grooves and lying closest to the outer side surface of its respective side flange facing away from the other of said side flanges, said length being greater than the distance between said circular grooves taken along a line parallel to said longitudinal axis of said hub; and said first end of said main body portion being spaced from the inner face of said first side flange to which it is connected by said first tongue extension, and said second end of said main body portion being spaced from the inner face of the portion of said second side flange to which it is connected by said second tongue extension, so that a first and a second gap is provided between the ends of said main body portion and the inner faces of said first and second side flanges, respectively wherein the locking projections of a conventional cover portion used for storing the reel during storage and non-use is received.

2. The improvement according to claim 1, wherein said main body portion has a thickness greater than the thickness of each of said first and said second tongue extensions, said thickness being measured in said first direction, the outer surface of said main body portion lying coplanar with portions of the outermost edge surfaces of said side flanges between which said main body portion extends; said outersurface of said main body portion having a radius of curvature equal to the radius of curvature of the outermost circumferential portion of each of said first and second side flanges.

3. A reel for dispensing tape therefrom comprising:

a hub having means for rotatably supporting the reel for rotation and unwinding of the tape;

a first side flange and a second side flange extending from opposite ends of said hub, each of said side flanges having a major diameter greater than the major diameter of said hub, whereby said flanges extend beyond the circumferential surface of said hub for all portions thereof to define a volume in which is stored and wound tape for paying out;

tape retarding means mounted between said first side flange and said second side flange near the outermost peripheral edges thereof, said tape retarding means being mounted for movement relative to said side flanges and relative to said hub;

first means on said first side flange for mounting a first end of said tape retarding means to said first side flange, and a second means on said second side flange for mounting a second end of said tape retarding means to said second side flange, each of said first and second means comprising arcuate means extending about the inner face of a respective flange;

said retarding means comprising a main body portion having a length less than the distance between the inner faces of said first and second side flanges taken along a line parallel with the longitudinal axis of said hub; each of said first and second ends of said retarding means having a first and second connecting means, respectively, for connecting said main body portion to said first and said second mounting means of said first and second side flanges, respectively, whereby gaps are provided between each flange and a respective end of said main body portion in which is received the locking projections of a conventional cover portion used for storing the reel during storage and non-use.

* * * * *